US008006354B2

(12) United States Patent
Cheng

(10) Patent No.: US 8,006,354 B2
(45) Date of Patent: Aug. 30, 2011

(54) PLATE CLIP WITH OPEN HANDLE

(75) Inventor: Hung Yu Cheng, Hong Kong (CN)

(73) Assignee: LECO Stationery Manufacturing Company Limited, Siu Yuen Shatin N.T., Hong Kong (CN)

( * ) Notice: Subject to any disclaimer, the term of this patent is extended or adjusted under 35 U.S.C. 154(b) by 868 days.

(21) Appl. No.: 11/997,315

(22) PCT Filed: Mar. 10, 2006

(86) PCT No.: PCT/CN2006/000363

§ 371 (c)(1),
(2), (4) Date: Jan. 29, 2008

(87) PCT Pub. No.: WO2007/014503

PCT Pub. Date: Feb. 8, 2007

(65) Prior Publication Data

US 2008/0196211 A1 Aug. 21, 2008

(30) Foreign Application Priority Data

Aug. 1, 2005 (CN) ..... 2005 1 0088670

(51) Int. Cl.
*B42F 9/00* (2006.01)

(52) U.S. Cl. ..... 24/67.5; 24/67.11; 24/67.3; 281/42; 281/45

(58) Field of Classification Search ..... 24/67 R, 24/67.3, 67.5, 67.7, 67.11; 281/21.1, 27.3, 281/45, 51; 248/451, 452
See application file for complete search history.

(56) References Cited

U.S. PATENT DOCUMENTS

| | | | | | |
|---|---|---|---|---|---|
| 256,138 | A | * | 4/1882 | Graham | 24/67.3 |
| 484,625 | A | * | 10/1892 | Austin | 24/67.11 |
| 491,011 | A | * | 1/1893 | Dom | 24/67.7 |
| 743,547 | A | * | 11/1903 | Nix | 24/67.7 |
| 1,373,988 | A | * | 4/1921 | Wallick | 24/67.11 |
| 2,524,457 | A | * | 10/1950 | Mattern | 24/67.3 |
| 2,642,841 | A | * | 6/1953 | Funk | 24/67.3 |
| 5,382,054 | A | * | 1/1995 | Bettiol | 281/45 |

FOREIGN PATENT DOCUMENTS

CN 1475368 A * 2/2004

* cited by examiner

*Primary Examiner* — Robert Sandy
(74) *Attorney, Agent, or Firm* — Global IP Services; Tianhua Gu

(57) ABSTRACT

A plate clip including a seat plate having a reel and a base plate, a pressing frame is pressed on the base plate by a spring, and an open handle. The open handle forming a lever is disposed on the pressing frame, and its fulcrum is at the reel. When a user opens the plate clip to clamp papers, he can press down the open handle to lift the pressing frame easily by the lever function, thus the finger of the user would not be injured accidentally.

3 Claims, 8 Drawing Sheets

PLATE CLIP WITH OPEN HANDLE

CROSS REFERENCE TO RELATED PATENT APPLICATION

This application claims the priority of the Chinese patent application No. 200510088670.4 with filing date of Aug. 1, 2005.

FIELD OF THE INVENTION

The present invention relates to a plate clip for clamping and holding a paper or a file. More particularly, the present invention relates to a plate clip with open handle.

BACKGROUND OF THE INVENTION

When an existing plate clip is opened to clamp and hold a file, a user usually need to lift a pressing frame of the plate clip directly, and then to put the file under the pressing frame. This kind of plate clip is used with great effort, and further more, it would injure accidentally the finger of the user in case of imprudence.

SUMMARY OF THE INVENTION

One object of the present invention is to overcome the defects of the present plate clip: difficult to open, clamp and press, easy to injure accidentally the finger of a user.

The further object of the present invention is to provide a new plate clip with an open handle, which can be opened easily by using the frame theory to clamp and press a file.

The technical solution is that, a plate clip with open handle comprising a seat plate with a reel and a base plate, and a pressing frame with opening at one side pressed on the said base plate by a spring. An open handle that forms a lever is disposed on the pressing frame.

Preferably, the open handle forms a lever and its fulcrum is at a reel.

Preferably, the open handle is a pressing piece disposed on the pressing frame. The pressing piece forms a sleeve by its lower end and suits to the pressing frame, so as to the pressing piece can be turned upward and downward.

Preferably, a through hole for hanging or a pressing piece cover to facilitate pressing is disposed on the up side of the pressing piece.

Preferably, the open handle is formed by directly bending the side opposite the other side with an opening of the pressing frame.

The advantages are: when a user opens the plate clip to clamp and press a paper, he can press down the open handle directly and lift the pressing frame easily by making use of lever theory, thus the finger of the user would not be injured accidentally; in addition, the design of the present is more human-centered as the through hole for hanging or pressing piece cover to facilitate pressing is disposed on the open handle for the convenience of use.

DETAIL DESCRIPTION OF THE INVENTION

Figure 1:
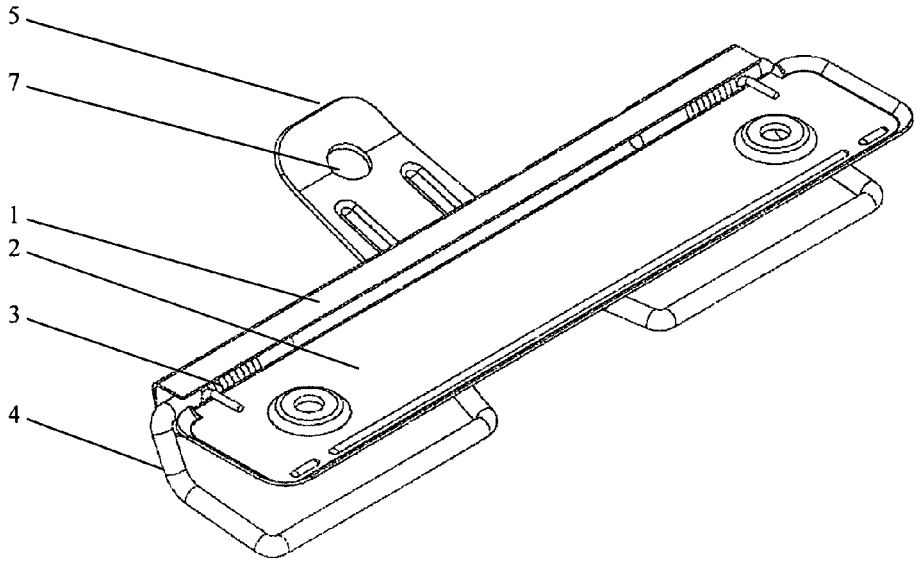
FIG. 1 is a structural illustrative diagram of the first embodiment of the present invention.
Figure 2:
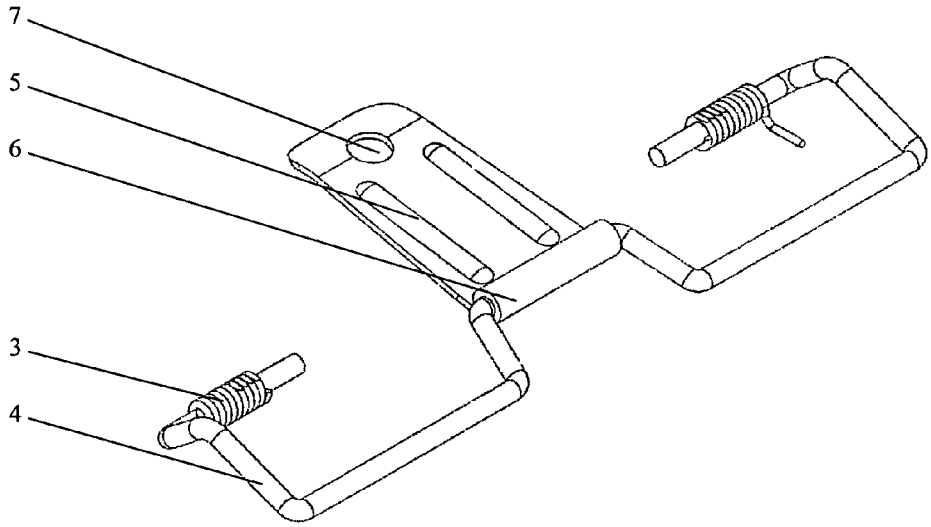
FIG. 2 is a connection illustrative diagram of the pressing frame, the pressing piece and the spring of the first embodiment of the present invention.
Figure 3:
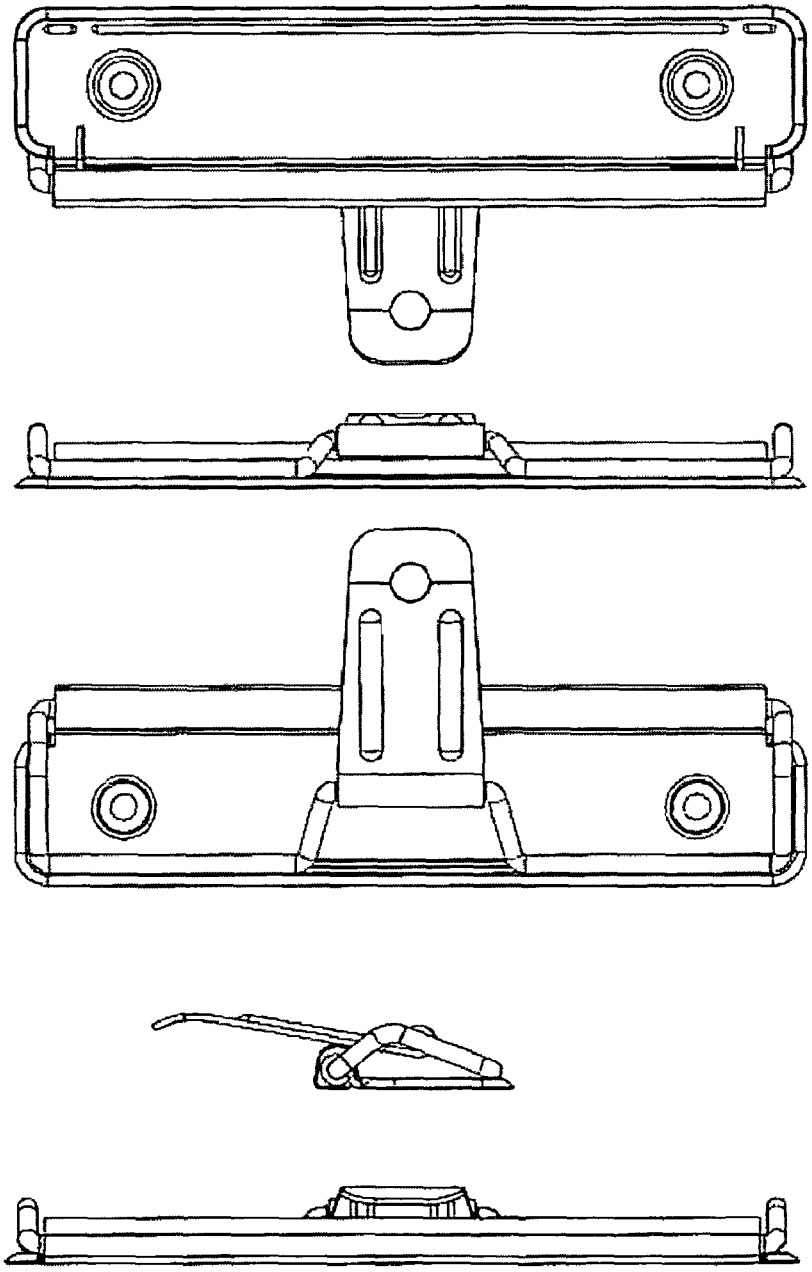
FIG. 3 is an upward view, a front view, a top view and a back view of the first embodiment of the present invention.
Figure 4:
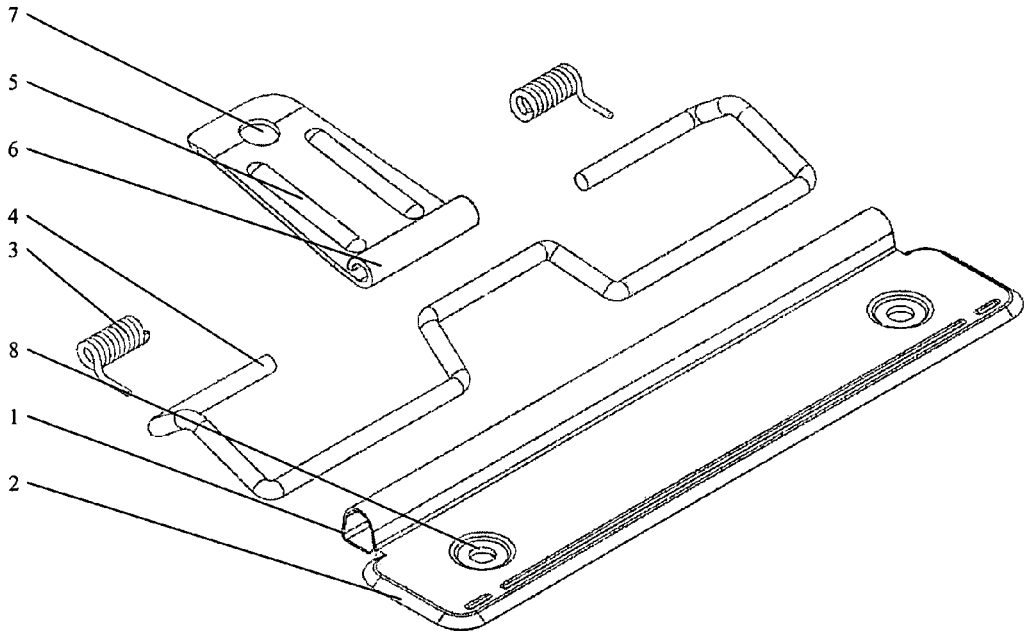
FIG. 4 is a disassemble structural illustrative diagram of the first embodiment of the present invention.
Figure 5:
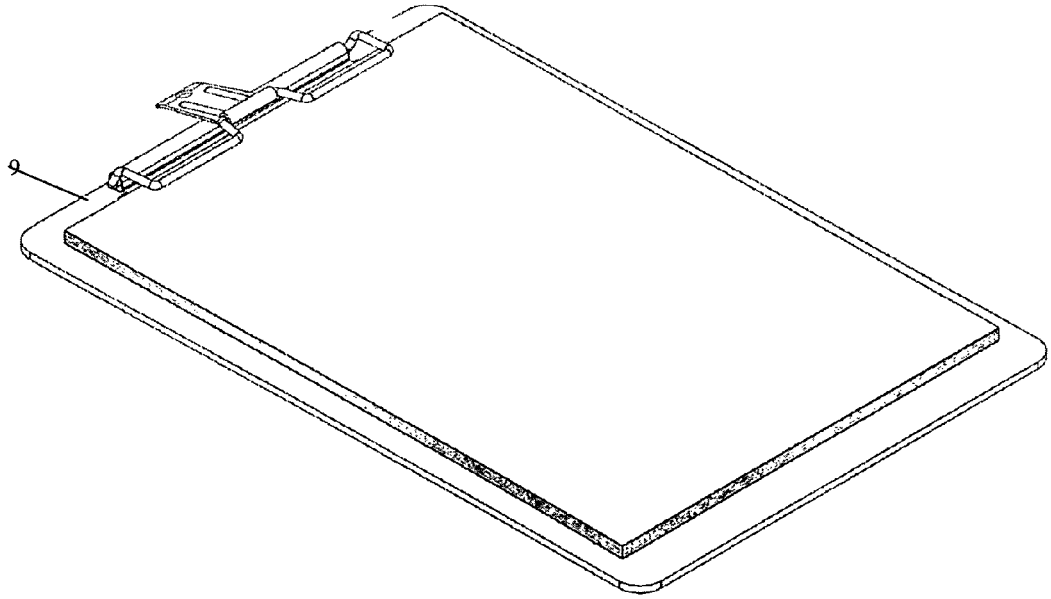
FIG. 5 is reference diagram 1 in use state of the first embodiment of the present invention.
Figure 6:
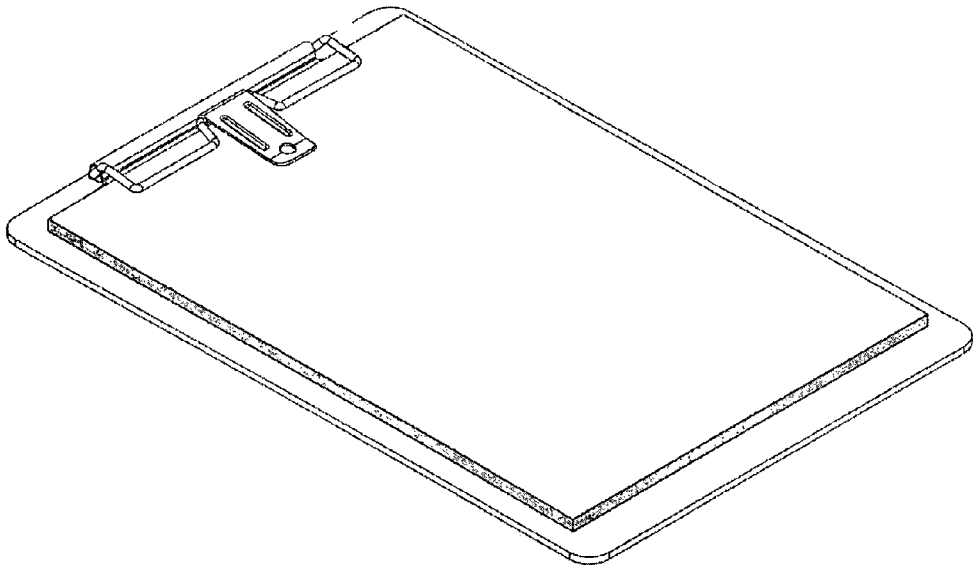
FIG. 6 is reference diagram 2 in use state of the first embodiment of the present invention.

The preferred embodiments of the present invention will be described with reference to the drawings.

As shown in the first embodiment of the present invention in FIG. 1 to FIG. 6, a plate clip comprising a seat plate with a reel 1 and a base plate 2, and a rectangular pressing frame 4 with opening at one side pressed on the said base plate 2 by a spring 3. At least two through holes 8 is disposed on the seat plate for fixing the plate clip on the back plate 9. An open handle is disposed on the pressing frame 4 which forms a lever and its fulcrum is at the reel 1. The open handle is a pressing piece 5 which is disposed on the side opposite the opening of the pressing frame 4. The pressing piece 5 forms a sleeve 6 by its lower end and suits to the pressing frame 4, so as to the pressing piece 5 can be turned upward and downward. A through hole 7 for hanging is disposed on the up side of the pressing piece 5.

Figure 7:
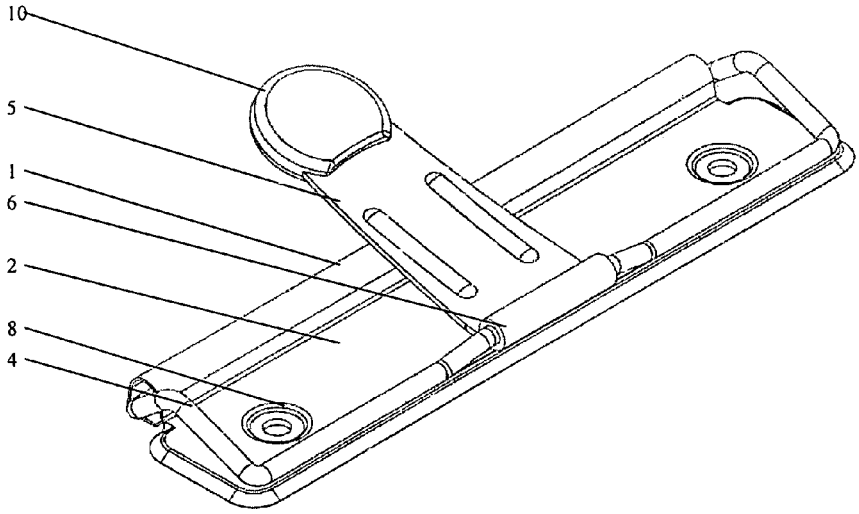
FIG. 7 is a structural illustrative diagram of the second embodiment of the present invention.
Figure 8:
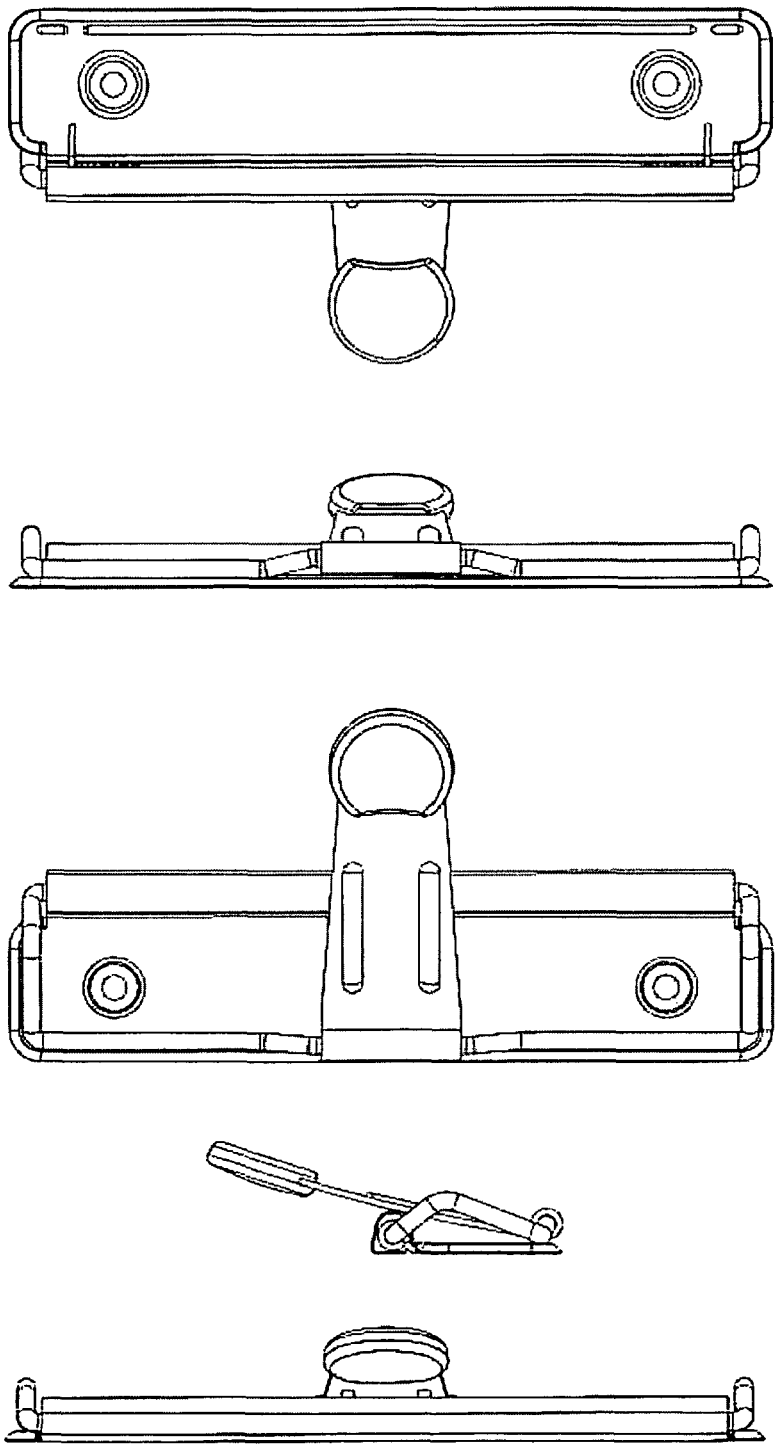
FIG. 8 is an upward view, a front view, a top view and a back view of the second embodiment of the present invention.
Figure 9:
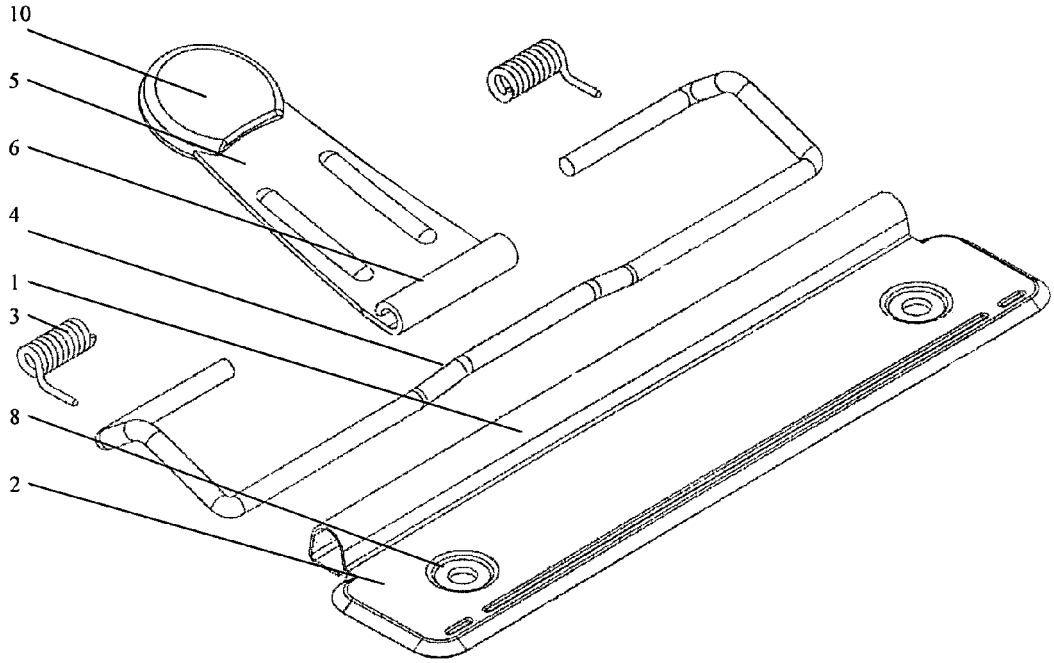
FIG. 9 is a disassemble structural illustrative diagram of the second embodiment of the present invention.

As shown in the second embodiment of the present invention in FIG. 7 to FIG. 9, a plate clip comprising a seat plate with a reel 1 and a base plate 2, and a rectangular pressing frame 4 with an opening at one side pressed on said base plate 2 by a spring 3. At least two through holes 8 is disposed on the seat plate for fixing the plate clip on the back plate 9. An open handle is disposed on the side opposite the opening of the pressing frame 4, which forms a lever and its fulcrum is at the reel 1. The open handle is a pressing piece 5. The pressing piece 5 forms a sleeve 6 by its lower end and suits to the pressing frame 4, so as to the pressing piece 5 can be turned upward and downward. A soft pressing piece cover 10 to facilitate pressing is disposed on the up side of the pressing piece 5.

Figure 10:
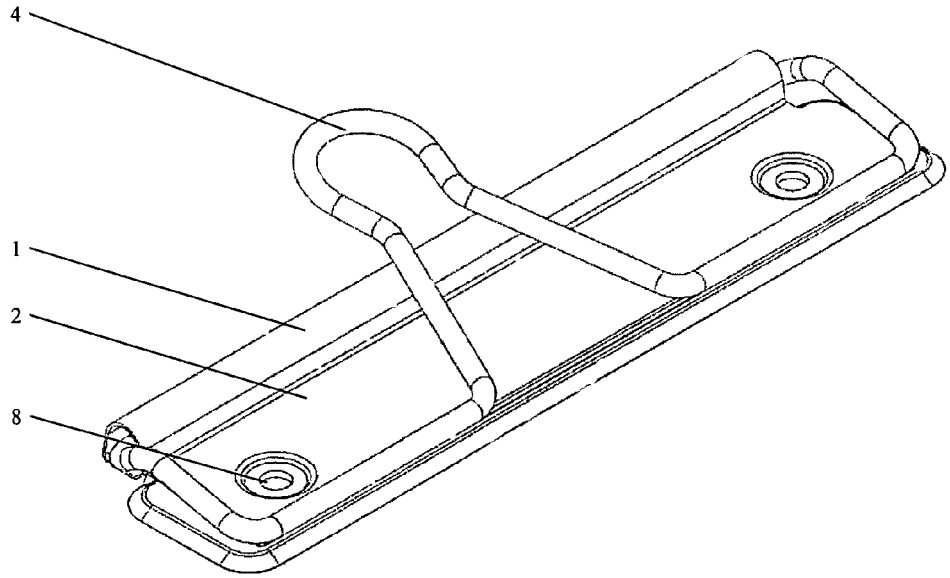
FIG. 10 is a structural illustrative diagram of the third embodiment of the present invention.
Figure 11:
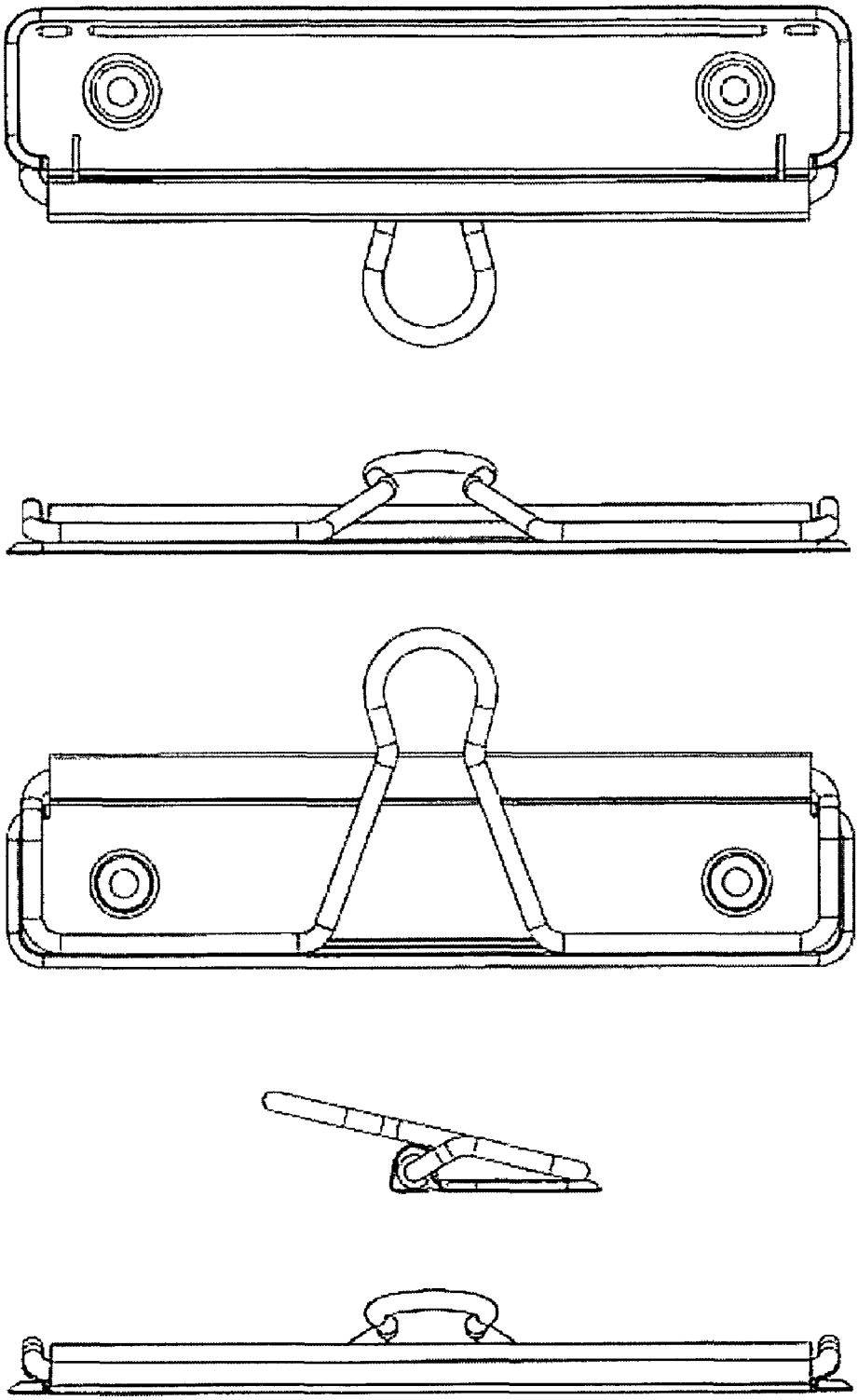
FIG. 11 is an upward view, a front view, a top view and a back view of the third embodiment of the present invention.
Figure 12:
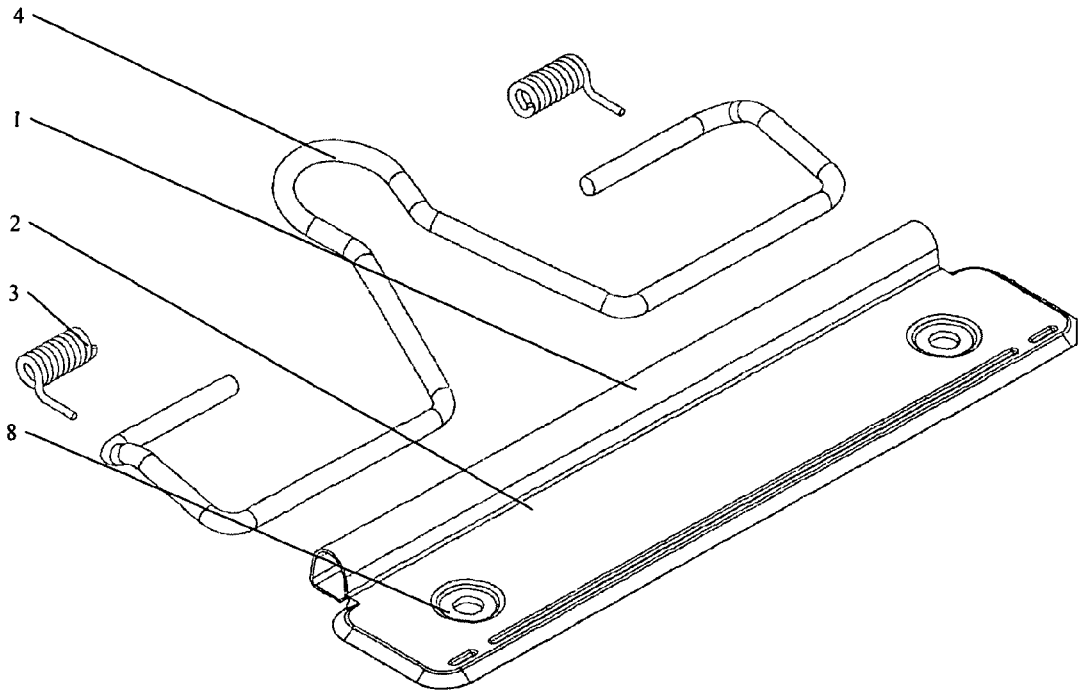
FIG. 12 is a disassemble structural illustrative diagram of the third embodiment of the present invention.

As shown in the third embodiment of the present invention in FIG. 10 to FIG. 12, a plate clip comprising a seat plate with a reel 1 and a base plate 2, and a rectangular pressing frame 4 with opening at one side pressed on said base plate 2 by a spring 3. At least two through holes 8 is disposed on the seat plate for fixing the plate clip on the back plate 9. The open handle is formed by bending the middle section of the side opposite to the opening side of the pressing frame 4 into a Ω shape, and it also forms a lever and its fulcrum is at the reel 1.

In use, a user can press down the back part of the open handle, and can lift the pressing frame 4 easily by making use of lever theory, then puts the file to be clamped between the pressing frame 4 and the back plate 9 and looses the open handle.

What is claimed is:

1. A plate clip with open handle comprising:

a seat plate having a reel and a base plate;

a pressing frame with opening at one side pressed on the said base plate by a spring;

an open handle with a fulcrum located at the real forming a lever being disposed on said pressing frame; and the open handle is a pressing piece, a lower end of the pressing piece forms a sleeve to slip on the pressing frame so as the pressing piece can be turned upward and downward.

2. The plate clip with open handle according to claim 1, wherein a through hole for hanging or a pressing piece cover to facilitate pressing is constructed on the up side of the pressing piece.

3. The plate clip with open handle according to claim 1,wherein the open handle is formed by bending the middle section of the side opposite to the opening side of the pressing frame into a Ω shape.

* * * * *